US007542580B2

(12) United States Patent
Burns

(10) Patent No.: US 7,542,580 B2
(45) Date of Patent: Jun. 2, 2009

(54) MICROPHONE PLACEMENT IN HEARING ASSISTANCE DEVICES TO PROVIDE CONTROLLED DIRECTIVITY

(75) Inventor: Thomas Howard Burns, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 260 days.

(21) Appl. No.: 11/457,858

(22) Filed: Jul. 17, 2006

(65) Prior Publication Data

US 2006/0291679 A1 Dec. 28, 2006

Related U.S. Application Data

(63) Continuation of application No. PCT/US2006/007058, filed on Feb. 27, 2006.

(60) Provisional application No. 60/656,795, filed on Feb. 25, 2005.

(51) Int. Cl.
*H04R 25/00* (2006.01)

(52) U.S. Cl. ..... 381/313; 381/322

(58) Field of Classification Search ..... 381/313, 381/322

See application file for complete search history.

(56) References Cited

U.S. PATENT DOCUMENTS 3,946,168 A 3/1976 Preves
4,072,821 A 2/1978 Bauer
4,548,082 A * 10/1985 Engebretson et al. ..... 381/320
4,837,832 A 6/1989 Fanshel
5,226,076 A 7/1993 Baumhauer, Jr. et al.
5,289,544 A 2/1994 Franklin
5,463,694 A 10/1995 Bradley et al.
5,524,056 A 6/1996 Killion et al.
5,715,319 A * 2/1998 Chu ..... 381/313
5,793,875 A 8/1998 Lehr et al.
5,794,187 A 8/1998 Franklin et al.
6,101,258 A 8/2000 Killion et al.
6,154,552 A 11/2000 Koroljow et al.

(Continued)

FOREIGN PATENT DOCUMENTS

EP 1091615 A1 4/2001

(Continued)

OTHER PUBLICATIONS

"International Search Report for corresponding PCT Application No. PCT/US2006/007058", (Jul. 14, 2006), 4 pgs.

*Primary Examiner*—Walter F Briney, III
(74) *Attorney, Agent, or Firm*—Schwegman, Lundberg & Woessner, P.A.

(57) ABSTRACT

The present disclosure includes various methods and apparatus for controlling directionality of a hearing assistance device including a pair of directional microphones. In various examples, the hearing assistance device includes a pair of directional microphones and an omnidirectional microphone. In various examples, the hearing assistance device includes a directional microphone and an omnidirectional microphone. In examples with multiple directional microphones, various angles can be employed. For example, in some applications the first directional axis can be about ninety degrees offset of the second directional axis. The microphones are aligned with an intended direction of reception in some embodiments. In some examples the microphones are not aligned with an intended direction of reception. Other variations are possible without departing from the scope of the present subject matter.

26 Claims, 7 Drawing Sheets

U.S. PATENT DOCUMENTS

| | | | |
|---|---|---|---|
| 6,327,370 | B1 | 12/2001 | Killion et al. |
| 6,424,721 | B1 | 7/2002 | Hohn |
| 6,473,409 | B1 * | 10/2002 | Malvar ..... 370/286 |
| 6,539,096 | B1 | 3/2003 | Sigwanz et al. |
| 6,724,903 | B2 | 4/2004 | Niederdrank |
| 6,798,890 | B2 | 9/2004 | Killion et al. |
| 6,925,189 | B1 | 8/2005 | Koroljow et al. |
| 6,928,171 | B2 | 8/2005 | Leber |
| 6,963,653 | B1 | 11/2005 | Miles |
| 2001/0036284 | A1 | 11/2001 | Leber |
| 2002/0057815 | A1 | 5/2002 | Killion |
| 2003/0072465 | A1 | 4/2003 | Fischer et al. |
| 2003/0142836 | A1 | 7/2003 | Warren et al. |
| 2003/0156725 | A1 | 8/2003 | Boone et al. |
| 2003/0179894 | A1 | 9/2003 | Saltykov |
| 2003/0215106 | A1 | 11/2003 | Hagen et al. |
| 2004/0022397 | A1 | 2/2004 | Warren |
| 2004/0161120 | A1 | 8/2004 | Petersen et al. |
| 2004/0184630 | A1 | 9/2004 | Ach-Kowalewski et al. |
| 2004/0240683 | A1 | 12/2004 | Niederdrank |
| 2004/0252852 | A1 | 12/2004 | Taenzer |
| 2004/0258249 | A1 | 12/2004 | Niederdrank et al. |
| 2005/0008166 | A1 | 1/2005 | Fischer et al. |
| 2005/0025325 | A1 | 2/2005 | Fischer |
| 2005/0041824 | A1 | 2/2005 | Arndt et al. |
| 2005/0058312 | A1 | 3/2005 | Weidner |
| 2005/0244018 | A1 | 11/2005 | Fischer et al. |

FOREIGN PATENT DOCUMENTS

| | | | |
|---|---|---|---|
| EP | 1365628 | A2 | 11/2003 |
| EP | 1448016 | A1 | 8/2004 |
| EP | 1509065 | A1 | 2/2005 |
| WO | WO-93/13590 | A1 | 7/1993 |
| WO | WO-94/24834 | A1 | 10/1994 |
| WO | WO-95/12961 | A1 | 5/1995 |
| WO | WO-97/40645 | A1 | 10/1997 |
| WO | WO-98/02969 | A1 | 1/1998 |
| WO | WO-99/39545 | A1 | 8/1999 |
| WO | WO-01/26415 | A1 | 4/2001 |
| WO | WO-02/03750 | A1 | 1/2002 |
| WO | WO-02/28140 | A1 | 4/2002 |
| WO | WO-2004/098233 | A1 | 11/2004 |
| WO | WO-2005/020633 | A1 | 2/2005 |
| WO | WO-2006091971 | A1 | 8/2006 |

* cited by examiner

MICROPHONE PLACEMENT IN HEARING ASSISTANCE DEVICES TO PROVIDE CONTROLLED DIRECTIVITY

CLAIM OF BENEFIT

This application is a continuation under 35 U.S.C. 111(a) of International Application No. PCT/US2006/007058 filed Feb. 27, 2006, which claims the benefit of U.S. Provisional Patent Application Ser. No. 60/656,795, filed Feb. 25, 2005, both of which are hereby incorporated by reference in their entirety.

FIELD OF DISCLOSURE

The present disclosure relates to hearing assistance devices, and in particular, to microphone placement in hearing assistance devices for controlled directivity.

BACKGROUND

Hearing aids are one form of hearing assistance devices that are used to correct for hearing loss. Hearing aids provide amplification of sound in ranges of hearing loss; however, simply amplifying sound is not necessarily adequate. Hearing aids also frequently require special attention to reduction of feedback and to placement of one or more microphones for proper hearing.

In one type of hearing aid, the behind-the-ear hearing aid ("BTE"), one or more microphones are found on the hearing aid enclosure that rests behind the ear. Such devices do not have the benefit of the ear's anatomy for reflecting sound to a focal point, such as at the ear canal. Thus, such devices may receive sounds from a different set of angles than which is normally heard. In noisy environments, the user may have difficulty hearing due to the reception of noise generally about the user.

There is a need in the art for a system which will provide controlled directivity of received sound for hearing assistance devices. Such a system should provide a controllable region of reception so that the user of a hearing assistance device can better discern sources, even in noisy environments.

SUMMARY

The above-mentioned problems and others not expressly discussed herein are addressed by the present subject matter and will be understood by reading and studying this specification.

The present disclosure provides various examples, some of which are apparatus, including: a hearing assistance device housing; a first directional microphone having first and second sound ports along a first axis, the first directional microphone producing a first audio signal; a second directional microphone having third and fourth sound ports along a second axis, the second directional microphone producing a second audio signal; and signal processing electronics for adjustment of phase and magnitude of first audio signal and the second audio signal, wherein the first, second, third, and fourth sound ports extend through the hearing assistance device housing.

In some examples the first directional microphone and the second directional microphone are aligned such that the first axis and the second axis are at an angle greater than zero degrees. In some examples, the first axis and the second axis are at 90 degrees. In some examples, an omnidirectional microphone produces a third signal, and the signal processing electronics include adjustment of phase and magnitude of the third audio signal.

Various examples, including, but not limited to, behind-the-ear, on-the-ear, over-the-ear, and in-the-ear hearing assistance devices are set forth. Various realizations, include signal processing electronics using a digital signal processor, microprocessor are discussed. The directional microphones can have a variety of cardioid, supercardioid, dipole, and hypercardioid reception patterns in various combinations.

In various aspects of the present subject matter an example includes an apparatus, having: a behind-the-ear hearing aid housing; a first directional microphone having first and second sound ports along a first axis, the first directional microphone producing a first audio signal; a second directional microphone having third and fourth sound ports along a second axis, the second directional microphone producing a second audio signal; a signal processor receiving the first audio signal and the second audio signal and adapted to adjust phase and amplitude of first audio signal and the second audio signal, and produce a summed signal; and a receiver (loudspeaker) to produce an audio signal based on the summed signal, wherein the first, second, third, and fourth sound ports extend through the hearing aid housing and wherein the first axis and second axis are offset by angle $\theta$. Various offsets including ninety degrees, and others, and various microphone orientations and offsets in the device are disclosed.

The present subject matter also includes a method, including: applying an amplitude A and a phase $\phi$ to a signal from a first directional microphone to produce a first signal; applying an amplitude C and phase $\psi$ to a signal from a second directional microphone to produce a second signal, the first directional microphone and second directional microphone having axes that intersect at an angle $\theta$; summing the first signal and the second signal to produce an output signal; and selecting values of A, C, $\phi$, $\psi$ and $\theta$ to provide a desired reception pattern from a combination of signals from the first directional microphone and the second directional microphone. In some variations, the method includes applying an amplitude B and phase $\alpha$ to a sound signal from an omnidirectional microphone to produce a third signal, and wherein the signal processing includes selecting values of B and $\alpha$ to provide the desired reception pattern. In some variations the summing includes producing magnitudes of the first signal and second signal; and adding the magnitudes. In some variations the summing includes adding the first signal and second signal using a complex addition process to create a complex sum; and producing a magnitude of the complex sum.

This Summary is intended to provide an overview of the subject matter of the present application and is not intended to be an exclusive or exhaustive explanation of the present subject matter. The reader is directed to the detailed description to provide further information about the subject matter of the present patent application.

DETAILED DESCRIPTION

The following detailed description refers to subject matter in the accompanying drawings which demonstrate some examples of specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references may contemplate more than one embodiment. The following detailed description is, therefore, not to be taken in a limiting sense, and the scope is defined only by the appended claims, along with the full scope of legal equivalents to which such claims are entitled.

The present subject matter relates to method and apparatus for control of a maximum angle of reception for hearing assistance devices. The examples provided demonstrate the subject matter on a behind-the-ear hearing device, however, it is understood that the principles provided herein can be applied to a variety of hearing assistance devices, including over-the-ear, on-the-ear, in-the-ear and other devices.

Figure 1:
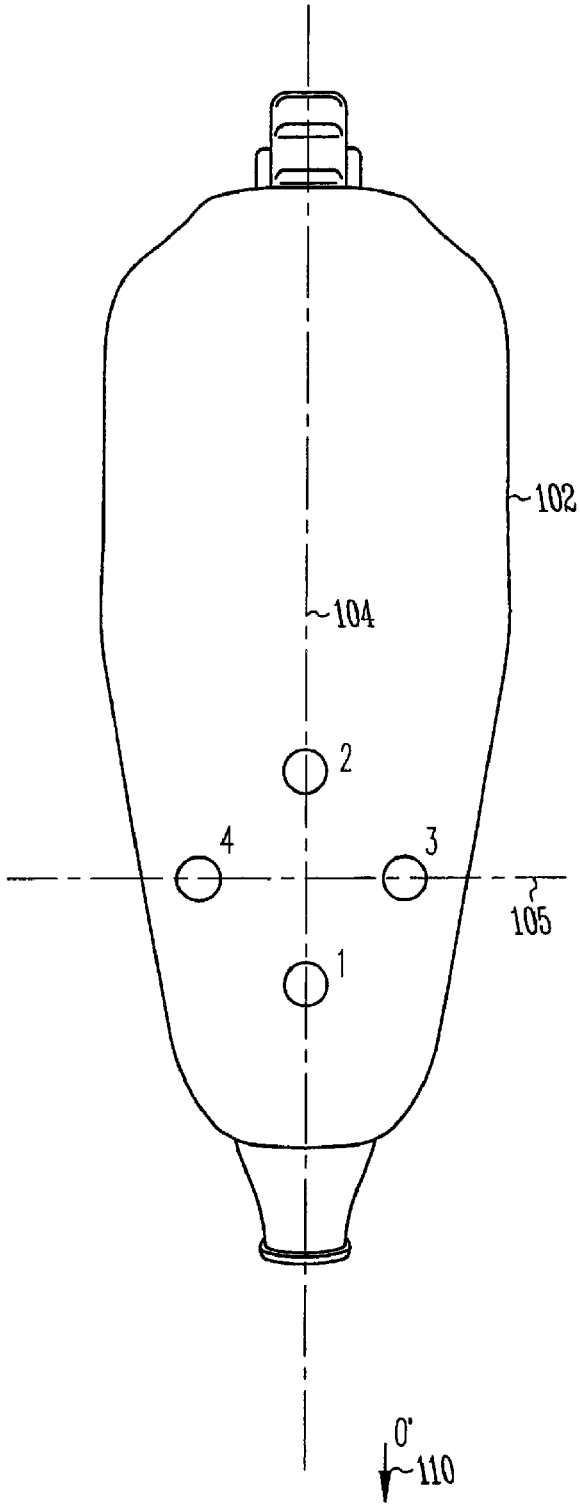
FIG. 1 shows a plan view of a behind-the-ear hearing aid including microphone placements according to one embodiment of the present subject matter.

FIG. 1 shows a plan view of a behind-the-ear hearing aid including microphone placements according to one embodiment of the present subject matter. In this example, the hearing assistance device 102 is a behind-the-ear (BTE) device, however, as stated above, the present subject matter can be applied to a variety of devices. The embodiment shown includes two directional microphones. Each directional microphone receives sound from a pair of sound ports. Thus, sound ports 1 and 2 are used by the first directional microphone and sound ports 3 and 4 are used by the second directional microphone. In some embodiments, an omnidirectional microphone (not shown) is added to the combination. Thus, FIG. 1 shows sound ports 1 and 2 being aligned along a first axis 104 and sound ports 3 and 4 aligned with a second axis 105. For convenience, the zero degree reference 110 in all of the following plan views will be pointing downward, as shown. This reference is not an absolute direction and used only to illustrate various angles and positions of microphone components and sound reception polar patterns throughout.

In FIG. 1, second axis 105 of sound ports 3 and 4 intersects first axis 104 of sound ports 1 and 2 at 90 degrees. In this embodiment, axis 104 coincides with the axis bisecting the plan view of the device 102. In various embodiments, the separation of the sound ports and intersection location of the sound port axes will not be uniform. Thus, in various embodiments the separation between sound ports 1 and 2 will be lesser than the separation between sound ports 3 and 4. In various embodiments the separation between sound ports 1 and 2 will be greater than the separation between sound ports 3 and 4. In various embodiments the separation between sound ports 1 and 2 will be equal to the separation between sound ports 3 and 4. In various embodiments the second axis will intersect the first axis at a location closer to sound port 1. In various embodiments the second axis will intersect the first axis at a location closer to sound port 2. In various embodiments the first axis will intersect the second axis at a location closer to sound port 3. In various embodiments, the first axis will intersect the second axis at a location closer to sound port 4. Thus, any number of orientations of ports 1, 2, 3, and 4, are contemplated providing that the first axis and second axis intersect at 90 degrees.

Figure 2:
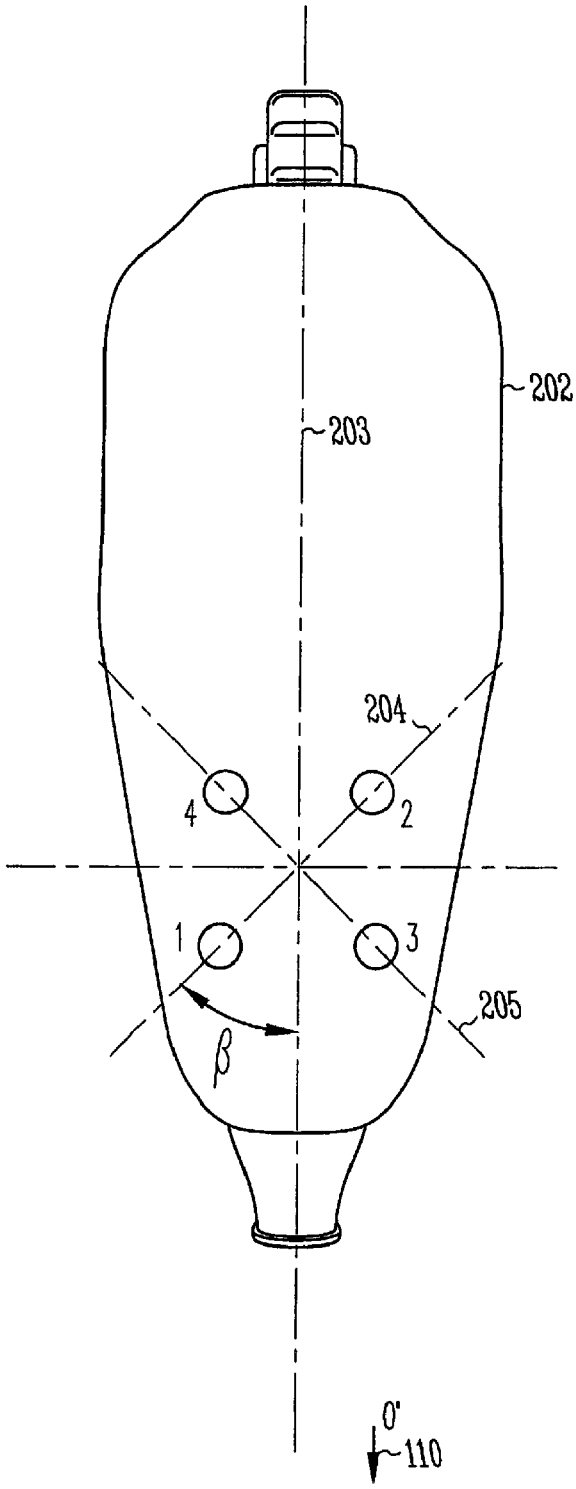
FIG. 2 shows a plan view of a behind-the-ear hearing aid including microphone placements, according to one embodiment of the present subject matter.

FIG. 2 shows a plan view of a behind-the-ear hearing aid including microphone placements, according to one embodiment of the present subject matter.

In this example, the hearing assistance device 202 is a behind-the-ear (BTE) device, however, as stated above, the present subject matter can be applied to a variety of devices. The embodiment shown includes two directional microphones. In some embodiments, an omnidirectional microphone (not shown) is added to the combination.

In FIG. 2, second axis 205 of sound ports 3 and 4 intersects first axis 204 of sound ports 1 and 2 at 90 degrees; however, in this embodiment, first axis 204 has been rotated by an acute angle relative to the axis 203 bisecting the plan view of the device 202. In various embodiments, the separation of the sound ports and intersection location of the sound port axes will not be uniform. Thus, in various embodiments the separation between sound ports 1 and 2 will be lesser than the separation between sound ports 3 and 4. In various embodiments the separation between sound ports 1 and 2 will be greater than the separation between sound ports 3 and 4. In various embodiments the separation between sound ports 1 and 2 will be equal to the separation between sound ports 3 and 4. In various embodiments the second axis will intersect the first axis at a location closer to sound port 1. In various embodiments the second axis will intersect the first axis at a location closer to sound port 2. In various embodiments the first axis will intersect the second axis at a location closer to sound port 3. In various embodiments, the first axis will intersect the second axis at a location closer to sound port 4. Thus, any number of orientations of ports 1, 2, 3, and 4, are contemplated providing that the first axis and second axis are at 90 degrees and the first axis is rotated by an acute angle $\beta$ relative to the bisecting axis 203. The example shown in FIG. 2 is intended to demonstrate one configuration with a $\beta$ of 45 degrees; however, it is understood that other values of $\beta$ may be used without departing from the principles set forth herein.

Figure 3:
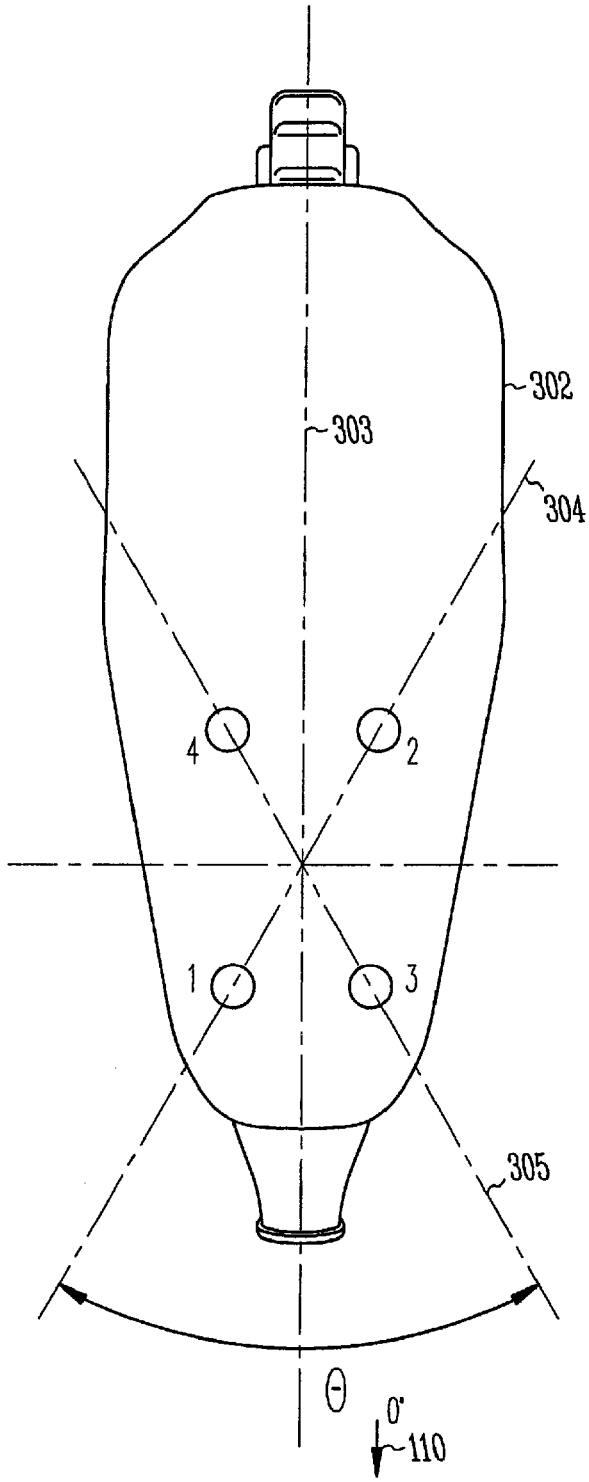
FIG. 3 shows a plan view of a behind-the-ear hearing aid including microphone placements, according to one embodiment of the present subject matter.

FIG. 3 shows a plan view of a behind-the-ear hearing aid including microphone placements, according to one embodiment of the present subject matter.

In this example, the hearing assistance device 302 is a behind-the-ear (BTE) device, however, as stated above, the present subject matter can be applied to a variety of devices. The embodiment shown includes two directional microphones. In some embodiments, an omnidirectional microphone (not shown) is added to the combination.

This configuration, in various embodiments, provides for the first axis to be at an angle from the second axis that is not 90 degrees. Thus, the symbol $\theta$ is the amount of angle between the first and second axis. Although, as the angle approaches 0 degrees or 180 degrees, the ports would physically overlap, a zero degree or 180 degree embodiment features the directional microphone ports having parallel axes where the ports are not overlapping. For example, where the ports are side-by-side. Alternate zero degree or 180 degree embodiments include, but are not limited to, where the ports are along the same axis, but displaced in distance from each other.

Figure 4:
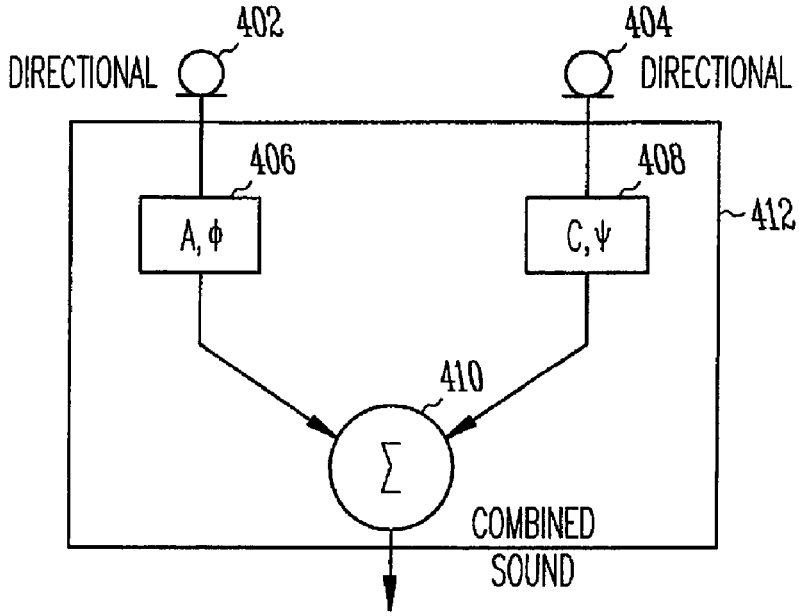
FIG. 4 shows a dual directional microphone system, according to one embodiment of the present subject matter.

FIG. 4 shows a dual directional microphone system, according to one embodiment of the present subject matter. Directional microphone 402 is mounted on the housing of a hearing assistance device to receive sound from ports 1 and 2, and directional microphone 404 is mounted similarly to receive sound from ports 3 and 4. Microphone 402 produces a time varying signal having both amplitude and phase. Signal processor 406 applies amplitude A and phase $\phi$ to the time varying signal to produce an output signal. In one embodiment, the signal processor 406 is filtering. In various embodiments, the filtering is performed in the frequency domain. In various embodiments, the filtering is performed in the time domain.

Microphone 404 produces a time varying signal having both amplitude and phase. Signal processor 408 applies amplitude C and phase $\psi$ to the time varying signal to produce an output signal. In one embodiment, the signal processor 408 is filtering. In various embodiments, the filtering is performed in the frequency domain. In various embodiments, the filtering is performed in the time domain. The output signals are summed by summer 410. In various embodiments additional signal processing is performed on the summed signal. A receiver (loudspeaker) receives the resulting output and produces audio signals based on it.

In one embodiment, summer 410 derives the magnitude of each input signal individually and then does an addition of the resulting magnitudes. In one embodiment, summer 410 does a complex addition of the signals and then derives an overall magnitude of the complex sum.

Different forms of directional microphones may be employed in various embodiments. For example, if directional microphones are used, such microphones can provide cardioid, supercardioid, dipole, or hypercardioid reception patterns for each individual directional microphone. Various embodiments include combinations of microphones having similar reception patterns. Various combinations include microphones having different reception patterns. Thus, various combinations of reception patterns can be accomplished, and the resulting summations of the reception fields can provide a distinctly different overall reception pattern for the hearing assistance device.

It is understood that the signal processors 406 and 408 and summer 410 can be implemented in hardware, software, or combinations thereof. In varying embodiments a processor 412 performs all of the operations. Processor 412, in various embodiments, is a digital signal processor. In some embodiments, processor 412 is a microprocessor. Other embodiments exist which do not depart from the scope of the present teachings.

Figure 5:
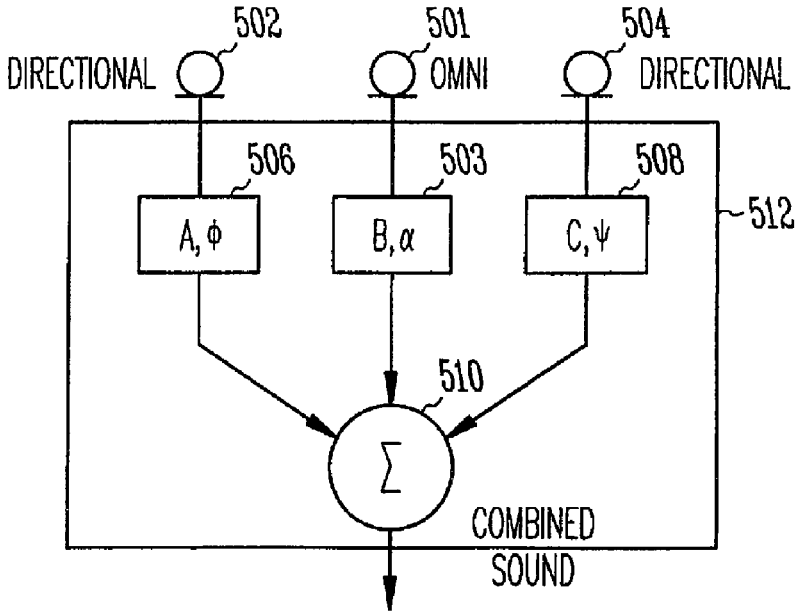
FIG. 5 shows a microphone system including two directional microphones and an omnidirectional microphone, according to one embodiment of the present subject matter.

FIG. 5 shows a microphone system including two directional microphones and an omnidirectional microphone, according to one embodiment of the present subject matter. Omnidirectional microphone 501 is mounted on the housing of a hearing assistance device to receive sound through a port. Omnidirectional microphone 501 produces a time varying signal having both amplitude and phase. Signal processor 503 applies amplitude B and phase a to the time varying signal to produce an output signal. In one embodiment, the signal processor 503 is filtering. In various embodiments, the filtering is performed in the frequency domain. In various embodiments, the filtering is performed in the time domain. The output is sent to summer 510.

Directional microphone 502 and is mounted on the housing of a hearing assistance device to receive sound from ports 1 and 2, and directional microphone 504 is mounted similarly to receive sound from ports 3 and 4. Microphone 502 produces a time varying signal having both amplitude and phase. Signal processor 506 applies amplitude A and phase $\phi$ to the time varying signal to produce an output signal. In one embodiment, the signal processor 506 is filtering. In various embodiments, the filtering is performed in the frequency domain. In various embodiments, the filtering is performed in the time domain. Microphone 504 produces a time varying signal having both amplitude and phase. Signal processor 508 applies amplitude C and phase $\psi$ to the time varying signal to produce an output signal. In one embodiment, the signal processor 508 is filtering. In various embodiments, the filtering is performed in the frequency domain. In various embodiments, the filtering is performed in the time domain. The output signals are summed by summer 510. In various embodiments additional signal processing is performed on the summed signal. A receiver (loudspeaker) receives the resulting output and produces audio signals based on it.

In one embodiment, summer 510 derives the magnitude of each input signal individually and then does an addition (or subtraction, which implies that the signal of one channel is multiplied by −1 before it is summed with the other channel) of the resulting magnitudes. In one embodiment, summer 510 does a complex addition of the signals and then derives an overall magnitude of the complex sum.

Different forms of directional microphones may be employed in various embodiments. For example, if directional microphones are used, such microphones can provide cardioid, supercardioid, dipole, or hypercardioid reception patterns for each individual directional microphone. Various embodiments include combinations of microphones having similar reception patterns. Various combinations include microphones having different reception patterns. Thus, various combinations of reception patterns can be accomplished, and the resulting summations of the reception fields can provide a distinctly different overall reception pattern for the hearing assistance device.

It is understood that the signal processors 503, 506 and 508 and summer 510 can be implemented in hardware, software, or combinations thereof. In varying embodiments a processor 512 performs all of the operations. Processor 512, in various embodiments, is a digital signal processor. In some embodiments, processor 512 is a microprocessor. Other embodiments exist which do not depart from the scope of the present teachings.

Figure 6:
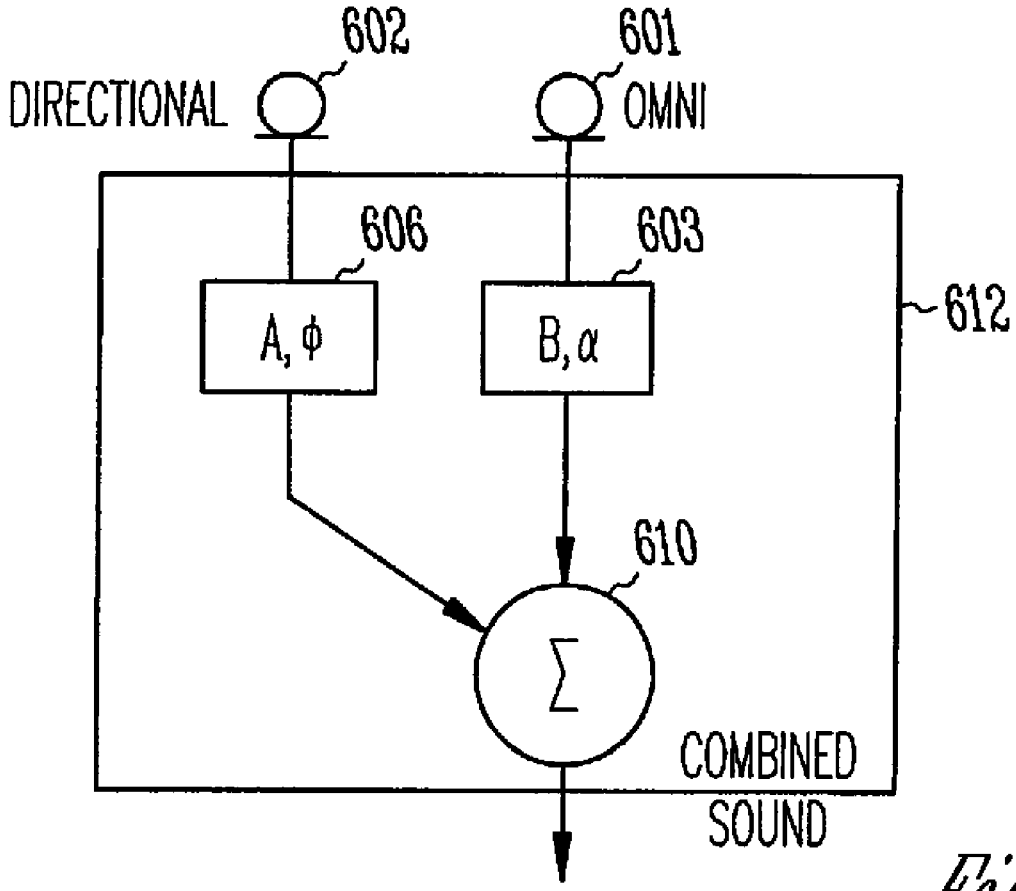
FIG. 6 shows a microphone system including a directional microphone and an omnidirectional microphone, according to one embodiment of the present subject matter.

FIG. 6 shows a microphone system including a directional microphone 602 and an omnidirectional microphone 601, according to one embodiment of the present subject matter. In one embodiment, this configuration is achieved through signal processing by substantially reducing the gain, turning off, or ignoring the audio signal of a second directional microphone, such as the directional signal of a system according to FIG. 5. In varying embodiments, this configuration is achieved by dedicated microphones 602 and 601 and signal processor 606 and 603, respectively, feeding signals to summer 610.

It is understood that the signal processors 603 and 606 and summer 610 can be implemented in hardware, software, or combinations thereof. In varying embodiments a processor 612 performs all of the operations. Processor 612, in various embodiments, is a digital signal processor. In some embodiments, processor 612 is a microprocessor. Other embodiments exist which do not depart from the scope of the present teachings.

For the embodiments set forth in FIGS. 5 and 6, it is understood that the placement of the omnidirectional microphone on the housing may vary. In one embodiment, the omnidirectional microphone resides in the vicinity, or even shares one, of the directional ports. Different locations on the housing can employed without departing from the scope of the present subject matter.

Figure 7:
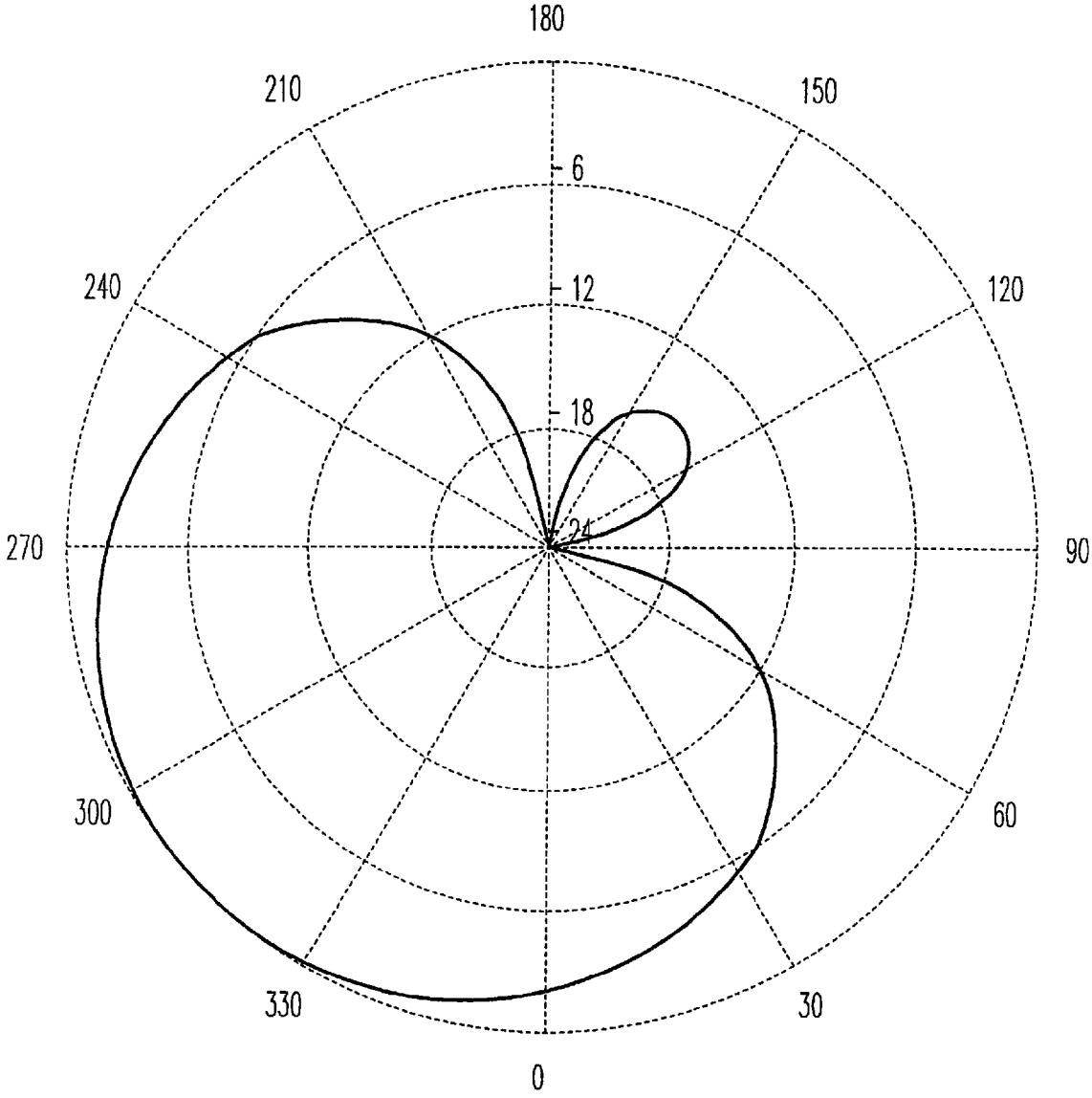
FIG. 7 is a polar plot showing one example of an angular reception pattern for a system operating according to one embodiment of the present subject matter and for a particular group of parameters for that system.

FIG. 7 is a polar plot showing one example of angular reception for a system operating according to one embodiment of the present subject matter and for a particular group of parameters for that system; namely, a cardioid directional microphone occupying ports 1 and 2 pointing towards 0° along axis 110, and a dipole directional microphone occupying ports 3 and 4 pointing along axis 105. The polar response is obtained by taking the magnitude of the complex sum (amplitude and phase) from each directional microphone. This polar response is frequency independent, assuming that the cardioid and dipole responses are frequency independent. For example, to achieve the polar pattern of FIG. 7, one sets A=C and $\phi=\psi$ in the system set forth in FIG. 4. It is understood that parameter values may be changed to change the reception pattern. Thus, the system is highly controllable and programmable.

Figure 8:
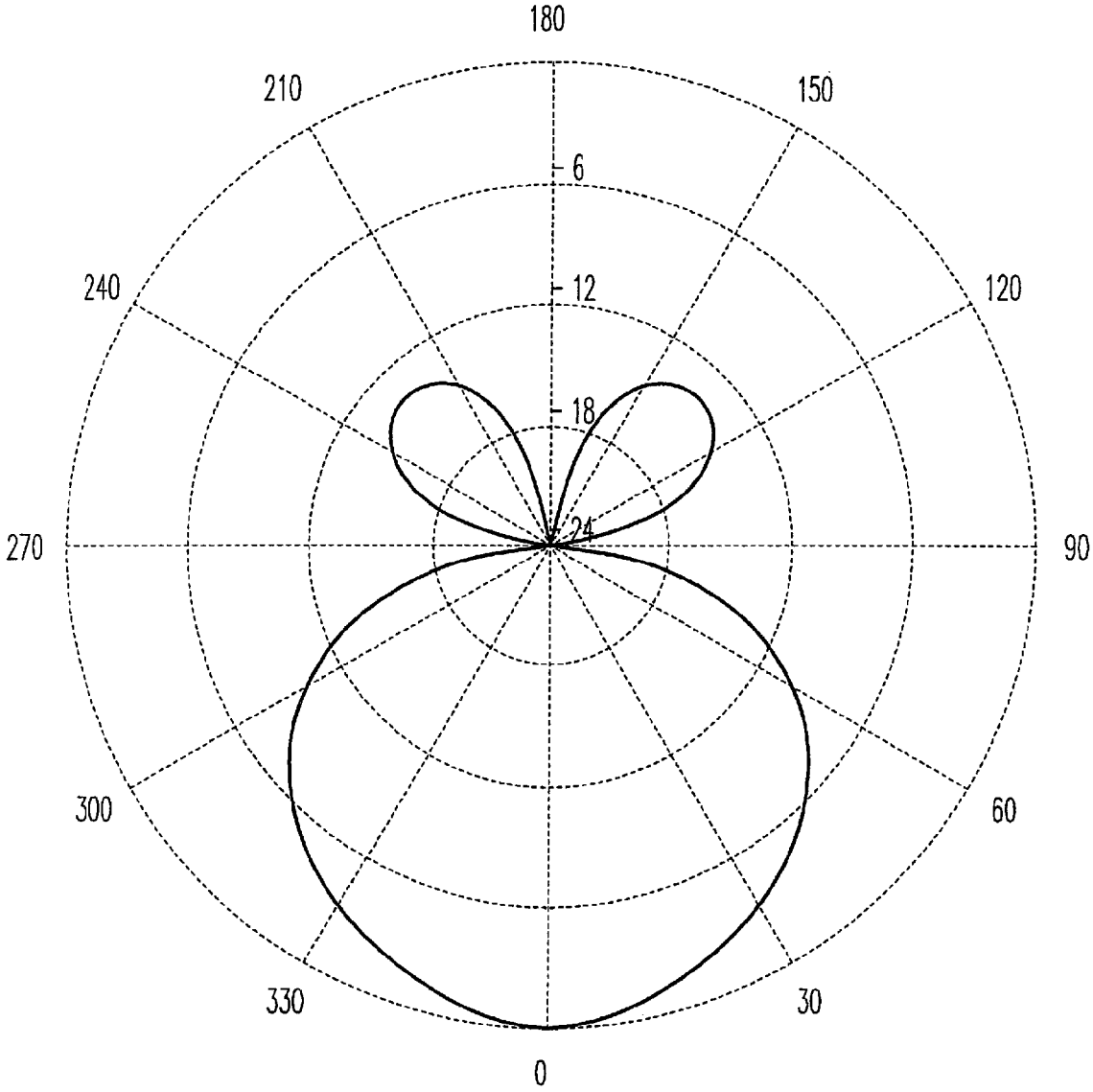
FIG. 8 is a polar plot showing one example of an angular reception pattern for a system operating according to one embodiment of the present subject matter and for a particular group of parameters for that system.

FIG. 8 is a polar plot showing one example of angular reception for a system operating according to one embodiment of the present subject matter and for a particular group of parameters for that system; namely, a cardioid directional microphone occupying ports 1 and 2 pointing towards 0° along axis 110, and a dipole directional microphone occupying ports 3 and 4 pointing along axis 105. The polar response is obtained by taking the difference between the cardioid magnitude and the dipole magnitude. This polar response is frequency independent, assuming that the cardioid and dipole responses are frequency independent. For example, to achieve the polar pattern of FIG. 8, one sets A=C and $\phi=\psi$, in the system set forth in FIG. 4. It is understood that parameter values may be changed to change the reception pattern. Thus, the system is highly controllable and programmable.

The present system controls the reception pattern by adjusting A, B, C, $\phi$, $\alpha$, $\psi$, $\beta$ and $\theta$ to produce a desired reception pattern. One way to set these parameters is to model the values using computer programs, such as MATLAB. Other programs and modeling may be performed without departing from the scope of the present subject matter.

It is understood for the embodiments set forth herein, that the port pairs can be separated by a number of various distances which are limited primarily by available space on the housing. For example, port pair distances 3 mm to 26 mm are possible in varying embodiments. Port spacings can vary between ports 1 and 2 as compared to the spacing of ports 3 and 4. Sound port shapes are shown as circular in the figures, but other shapes may be employed without departing from the scope of the present subject matter. For purposes of the discussion throughout this disclosure, port shapes are demonstrative only and can thus have various shapes and surface areas or can be covered with an acoustically appropriate material so that their features are not visible.

It is understood that the present subject matter provides a great deal of flexibility and programmability. In various embodiments, an axis of the microphones is aligned with an intended direction of reception. In various embodiments, an axis of the microphones is offset from an intended direction of reception.

In various embodiments, the resulting signal from the foregoing embodiments is amplified and sent to a receiver (loudspeaker), which produces an audio version of the resulting signal. An additional processing step can occur before amplification if desired. In wireless applications, the resulting signal can be transmitted using radio frequency energy. Other uses of the resulting signal are possible without departing from the scope of the present subject matter.

Although specific embodiments have been illustrated and described herein, it will be appreciated by those of ordinary skill in the art that any arrangement which is calculated to achieve the same purpose may be substituted for the specific embodiment shown. This application is intended to cover adaptations or variations of the present subject matter. It is to be understood that the above description is intended to be illustrative, and not restrictive. Combinations of the above embodiments, and other embodiments, will be apparent to those of skill in the art upon reviewing the above description. The scope of the present subject matter should be determined with reference to the appended claims, along with the full scope of equivalents to which such claims are entitled.

What is claimed is:

1. An apparatus, comprising:

a hearing assistance device housing;

a first directional microphone having first and second sound ports along a first axis, the first directional microphone producing a first audio signal;

a second directional microphone having third and fourth sound ports along a second axis, the second directional microphone producing a second audio signal; and signal processing electronics for adjustment of phase and amplitude of the first audio signal and the second audio signal, wherein the first, second, third, and fourth sound ports extend through the hearing assistance device housing, and wherein the first axis and second axis intersect each other at a location on an axis bisecting a plan view of the hearing assistance device housing.

2. The apparatus of claim 1, wherein the first directional microphone and the second directional microphone are aligned such that the first axis and the second axis intersect at an angle greater than zero degrees.

3. The apparatus of claim 2, further comprising an omnidirectional microphone producing a third signal, and wherein the signal processing electronics include adjustment of phase and amplitude of the third audio signal.

4. The apparatus of claim 1, wherein the first axis and the second axis are at 90 degrees.

5. The apparatus of claim 3, further comprising an omnidirectional microphone producing a third signal, and wherein the signal processing electronics include adjustment of phase and amplitude of the third audio signal.

6. The apparatus of claim 1, further comprising an omnidirectional microphone producing a third signal, and wherein the signal processing electronics include adjustment of phase and amplitude of the third audio signal.

7. The apparatus of claim 1, wherein the hearing assistance device housing is a behind-the-ear hearing aid housing.

8. The apparatus of claim 1, wherein the hearing assistance device housing is an on-the-ear hearing aid housing.

9. The apparatus of claim 1, wherein the hearing assistance device housing is an over-the-ear hearing aid housing.

10. The apparatus of claim 1, wherein the signal processing electronics is a digital signal processor.

11. The apparatus of claim 1, wherein the signal processing electronics is a microprocessor.

12. The apparatus of claim 1, wherein the first directional microphone has a cardioid reception pattern.

13. The apparatus of claim 12, wherein the second directional microphone has one of a cardioid, supercardioid, dipole, or hypercardioid reception pattern.

14. The apparatus of claim 1, wherein the first directional microphone has a supercardioid reception pattern.

15. The apparatus of claim 14, wherein the second directional microphone has one of a cardioid, supercardioid, dipole, or hypercardioid reception pattern.

16. The apparatus of claim 1, wherein the first directional microphone has a dipole reception pattern.

17. The apparatus of claim 16, wherein the second directional microphone has one of a cardioid, supercardioid, dipole, or hypercardioid reception pattern.

18. The apparatus of claim 1, wherein the first directional microphone has a hypercardioid reception pattern.

19. The apparatus of claim 18, wherein the second directional microphone has one of a cardioid, supercardioid, dipole, or hypercardioid reception pattern.

20. An apparatus, comprising:

a behind-the-ear hearing aid housing;

a first directional microphone having first and second sound ports along a first axis, the first directional microphone producing a first audio signal;

a second directional microphone having third and fourth sound ports along a second axis, the second directional microphone producing a second audio signal;

a signal processor receiving the first audio signal and the second audio signal and adapted to adjust phase and amplitude of first audio signal and the second audio signal, and produce a summed signal; and a receiver (loudspeaker) to produce an audio signal based on the summed signal, wherein the first, second, third, and fourth sound ports extend through the hearing aid housing and wherein the first axis and second axis intersect each other at angle $\theta$ and at a location on an axis bisecting a plan view of the behind-the-ear hearing aid housing.

21. The apparatus of claim 20, wherein the first axis and second axis intersect at 90 degrees.

22. The apparatus of claim 20, wherein the first axis is in alignment to the axis bisecting the plan view of the behind-the-ear hearing aid housing.

23. The apparatus of claim 20, wherein the first axis is offset of the axis bisecting the plan view of the behind-the-ear hearing aid housing.

24. A method, comprising:

applying an amplitude A and a phase $\phi$ to a signal from a first directional microphone to produce a first signal;

applying an amplitude C and phase $\psi$ to a signal from a second directional microphone to produce a second signal, the first directional microphone and second directional microphone having axes that intersect at an angle $\theta$;

adding or subtracting the first signal and the second signal using a complex addition or substraction process to create a complex sum;

producing a magnitude of the complex sum; and selecting values of A, C, $\phi$, $\psi$ and $\theta$ to provide a desired reception pattern from a combination of signals from the first directional microphone and the second directional microphone.

25. The method of claim 24, further comprising:

applying an amplitude B and phase $\alpha$ to a sound signal from an omnidirectional microphone to produce a third signal, and wherein the signal processing includes selecting values of B and $\alpha$ to provide the desired reception pattern.

26. The method of claim 24, wherein the summing includes:

producing magnitudes of the first signal and second signal; and adding the magnitudes.

* * * * *

UNITED STATES PATENT AND TRADEMARK OFFICE

CERTIFICATE OF CORRECTION

PATENT NO. : 7,542,580 B2
APPLICATION NO. : 11/457858
DATED : June 2, 2009
INVENTOR(S) : Thomas H. Burns It is certified that error appears in the above-identified patent and that said Letters Patent is hereby corrected as shown below:

In column 10, line 16, in Claim 24, delete "substraction" and insert -- subtraction --, therefor.

Signed and Sealed this

First Day of September, 2009

David J. Kappos

David J. Kappos
*Director of the United States Patent and Trademark Office*